US006517430B1

(12) United States Patent
Leimu

(10) Patent No.: US 6,517,430 B1
(45) Date of Patent: Feb. 11, 2003

(54) SUPPLY AIR SYSTEM

(75) Inventor: Juha Leimu, Turku (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/980,004

(22) PCT Filed: May 19, 2000

(86) PCT No.: PCT/FI00/00452

§ 371 (c)(1),
(2), (4) Date: Feb. 12, 2002

(87) PCT Pub. No.: WO00/71941

PCT Pub. Date: Nov. 30, 2000

(30) Foreign Application Priority Data

May 20, 1999 (FI) ..... 991150

(51) Int. Cl.[7] ..... F24F 3/02
(52) U.S. Cl. ..... 454/186; 454/251; 454/338
(58) Field of Search ..... 454/186, 187, 454/236, 251, 338

(56) References Cited

U.S. PATENT DOCUMENTS 2,104,024 A * 1/1938 Conboie
3,835,758 A * 9/1974 Bean ..... 454/236

FOREIGN PATENT DOCUMENTS

| | | |
|---|---|---|
| EP | 0 667 946 B1 | 11/1993 |
| FI | 860635 | 9/1990 |
| FI | 91319 | 2/1994 |
| FI | 97166 | 12/1997 |
| SE | 465 182 | 8/1991 |
| SE | 508 633 | 10/1998 |

OTHER PUBLICATIONS

Ventilation Products Catalogue, ABB Ventilation 1995, "EU 2000–Luftbehandlingsaggregat". English p. 2.
Ventilation Product Catalogue, ABB Ventilation 1996, "Kompaktaggregat ABZ, Storlek 1–4". English p. 5.

* cited by examiner

*Primary Examiner*—Harold Joyce
(74) *Attorney, Agent, or Firm*—Lathrop & Clark LLP

(57) ABSTRACT

A supply air system for supplying air e.g. into a machine room. The supply air system comprises a supply air unit (12), to which means are connected for supplying the supply air from the outside air to the internal space, and an air treatment unit (14) in which means (58, 64) are arranged for treating the air supplied into the internal space. The units are interconnected by at least one duct (16, 16'), equipped with a blower. The supply air system further comprises an air distribution plate or the like for distributing the treated air into the machine room. The above-mentioned units are mounted on top of each other, so that the supply air unit (12) is arranged above the air treatment unit, so that an air chamber (20) for the treated air is formed between said units. At least a part of the air chamber borders to said air distribution plate (18, 18'). The air treatment unit (14) is arranged to supply treated air, such as cleaned air and/or air regulated to a desired temperature, into said air chamber.

21 Claims, 2 Drawing Sheets

SUPPLY AIR SYSTEM

Figure 1:
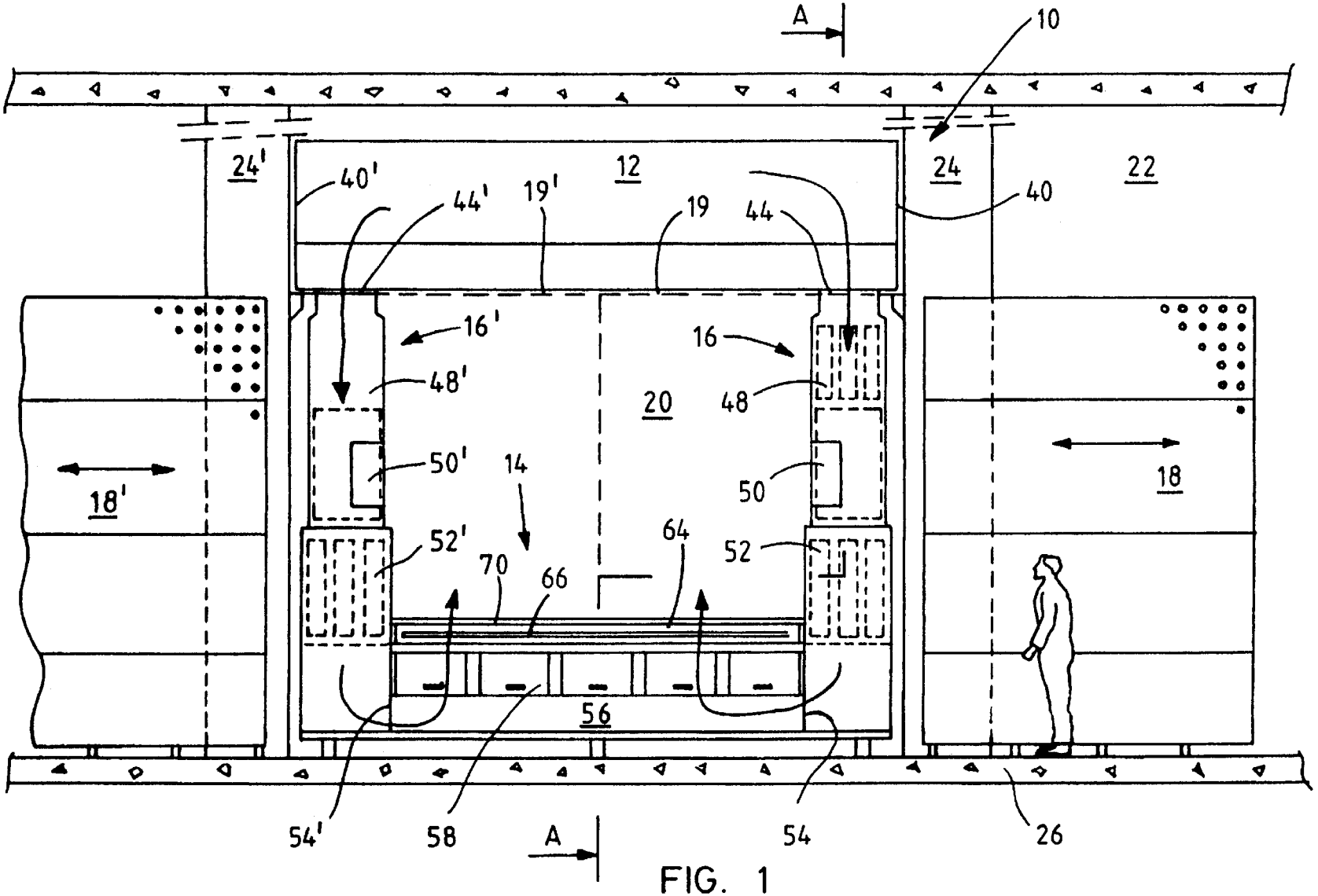

The present invention relates to a supply air system defined in the preamble of the first claim presented below for feeding air into large spaces, such as machine rooms in paper mills or de-inking plants.

A conventional supply air system comprises typically means for supplying supply air from the open air to the internal space, at least one blower, means for cleaning and/or for regulating a desired temperature of the air supplied to the internal space, and an air distribution plate or the like for evenly distributing the air, which is cleaned and/or regulated to a desired temperature, to the desired location.

The equipment of the supply air system was earlier generally arranged on the roof of the mill, or in some cases in the basement. It can be very difficult to find sufficiently suitable space for the equipment in a basement. Generally there is space on the roof, but often it is inconvenient to mount the air ducts, the heat transfer piping and the electrical cabling to the roof from different locations. Further the arrangement of heavy equipment on the roof may require extra support of the roof. However, the greatest problem may probably be that the maintenance of the equipment on the roof is inconvenient; depending on the weather conditions the maintenance can some times be almost impossible.

Previously the Finnish patent FI 97166 proposed to install the air treatment equipment on the wall of the machine room within a housing structure arranged between two vertical columns. Then an opening is made in the wall in the region of the upper part of the housing, and external air is.supplied to the housing through the opening. Air louvers and a radiator heating the supply air are fastened to the wall, at the level of the opening. A plurality of blowers is arranged in the air space of the housing below the opening. The blowers are mounted on a horizontal plane fastened to the wall. The bottom part of the housing forms an air chamber from which the treated air is fed into the machine room. In this case the wall between the air chamber and the machine room is formed by a perforated plate. In this solution the maintenance objects, filters, louvers, blowers, are mounted about 4 to 5 meters above the floor level of the machine room, which makes the maintenance of the equipment inconvenient. No solutions have been proposed regarding the noise problems caused by the blowers which are freely located in the housing.

Now the object of the present invention is to provide an improvement to the problems presented above.

The object is then particularly to provide a supply air system with easily accessible maintenance objects.

An object is also to provide a supply air system where the blowers can be easily provided with silencers and where the housing structures can be advantageously made soundproof.

In order to achieve the above-mentioned objects the system according to the invention is characterised in what is presented below in the characterising part of the first claim.

A typical supply air system according to the invention is formed by two separate units, the supply air unit and the air treatment unit, which are interconnected by one, advantageously at least two air ducts.

Thus the supply air system can be advantageously formed by supply air unit modules, air treatment unit modules and duct modules, which can be separately transported to the installation site. On the installation site the modules can be mounted on top of each other, so that the air treatment unit is first mounted on the floor level or on any other bearing surface carrying the system. The ducts which interconnect the supply air unit and the air treatment unit, typically two ducts, are mounted on the air treatment unit or on its sides. The ducts can be fastened to floor level or to a suitable bearing support surface. Then the supply air unit is mounted on the ducts. Thus the machine room floor or another corresponding carrying support surface acts as the support surface for the whole system.

The whole supply air system is advantageously dimensioned so that it can be arranged between two columns in the machine room. The system is typically arranged between columns next to the wall in the machine room, but when required, it can be arranged between two freely standing columns.

The supply air system is typically arranged in the actual machine room on machine level or in the basement located below the machine room. The supply air system can. be arranged to blow air from both spaces into the machine room and/or basement.

An inlet opening is formed at the supply air unit arranged next to the wall, in order to feed external air to the internal space or to the supply air unit. A louver directing the air flow can be arranged at the inlet opening, in the actual opening, in front of the opening, or after the opening. To a supply air unit arranged freely between columns the air is supplied with a duct from a place which is best suited, through the wall or the ceiling.

Means are arranged in the air treatment unit for cleaning the air supplied to the internal space and/or for regulating the temperature to a desired level. Often this entails heating the external air to a suitable level with the aid of a heating radiator. In some cases it may be necessary that the air entering the supply air unit is cooled by a cooling radiator.

In the solution according to the invention the supply air unit is mounted above the air treatment unit, so that an air space is left between the units, in other words so that a so-called air chamber is formed between the units. Typically the top part of the air chamber borders to the supply air unit, its bottom part borders to the air treatment unit, its back side borders to the machine room wall or some other corresponding backing structure, and its sides border at least partly to the air ducts. Further, the front of the air chamber borders, at least partly, to an air distribution plate or the like which is permeable to air, and through which the treated air is supplied to the machine room. The air flow is generated by a blower or blowers which advantageously are located in the ducts interconnecting the supply air unit and the air treatment unit. Thus the duct walls at the same time form a sound insulating layer around the blower. The blower can be advantageously located in the upper part of the duct, so that there is space left for a silencer in the lower part of the duct.

The blowers mounted in the ducts are advantageously axial blowers. However, the air flow can be generated in the system also by one or more centrifugal blowers arranged e.g. in the supply air unit and arranged to blow air down towards the ducts.

The blower generates an air flow from the external air trough the supply air system and into the machine room. Then the air flows from the opening formed in the wall, through the supply air unit and towards the top part of the ducts connected to this unit, and further downwards via the blower in the duct, to the lower part of the duct. From the lower part of the duct the air flow turns to one side towards the air box in the lower part of the air treatment unit. From this air box the air flows upwards through the air treatment unit and into the air chamber between the different units.

When the air flow comes from the duct into the air treatment unit it makes generally a turn of 180 degrees, from a downward flow into an upward flow. In the air treatment unit the air flows through the currently used treatment device, such as a filter and/or a heat transfer radiator.

The treated air flowing to the air chamber flows through the air chamber and out from the box to the machine room, through a wall between the box and the machine room provided with openings or the like flow passages. Different guiding plates can be arranged in the air chamber in order to direct the air flow in a desired manner within the air chamber, for instance also toward the gap between the air treatment unit and the distribution plate.

Within the air chamber and above the air treatment unit there can be arranged a maintenance gallery, which typically is a grating withstanding walking on it. From the maintenance gallery the maintenance personnel can service the blowers via a manhole made in the duct, or the heating radiators via openings in the maintenance gallery.

The vertical wall between the air chamber and the machine room, which wall forms the actual air distribution plate of the system, can be advantageously made of one or more perforated plates, or of perforated plate sections fastened to each other, which perforated plates are arranged to be movable like a "sliding door" or a "common door" in front of the air chamber. When the air distribution plates formed by perforated plates are in their place in front of the air chamber the air can flow from the air chamber into the machine room mainly only through the openings in the plate. During maintenance the air distribution plates can be pulled away from its position in front of the air chamber, so that a service person can service the devices in the system.

In the solution according to the invention the supply air unit can be formed of a horizontal box structure in which the walls toward the machine room can be lined so that they insulate sound. Correspondingly the devices in the air treatment unit can be arranged in a horizontal box structure, where the walls bordering to the air distribution box or other parts can be lined so that they insulate sound.

Figure 2:
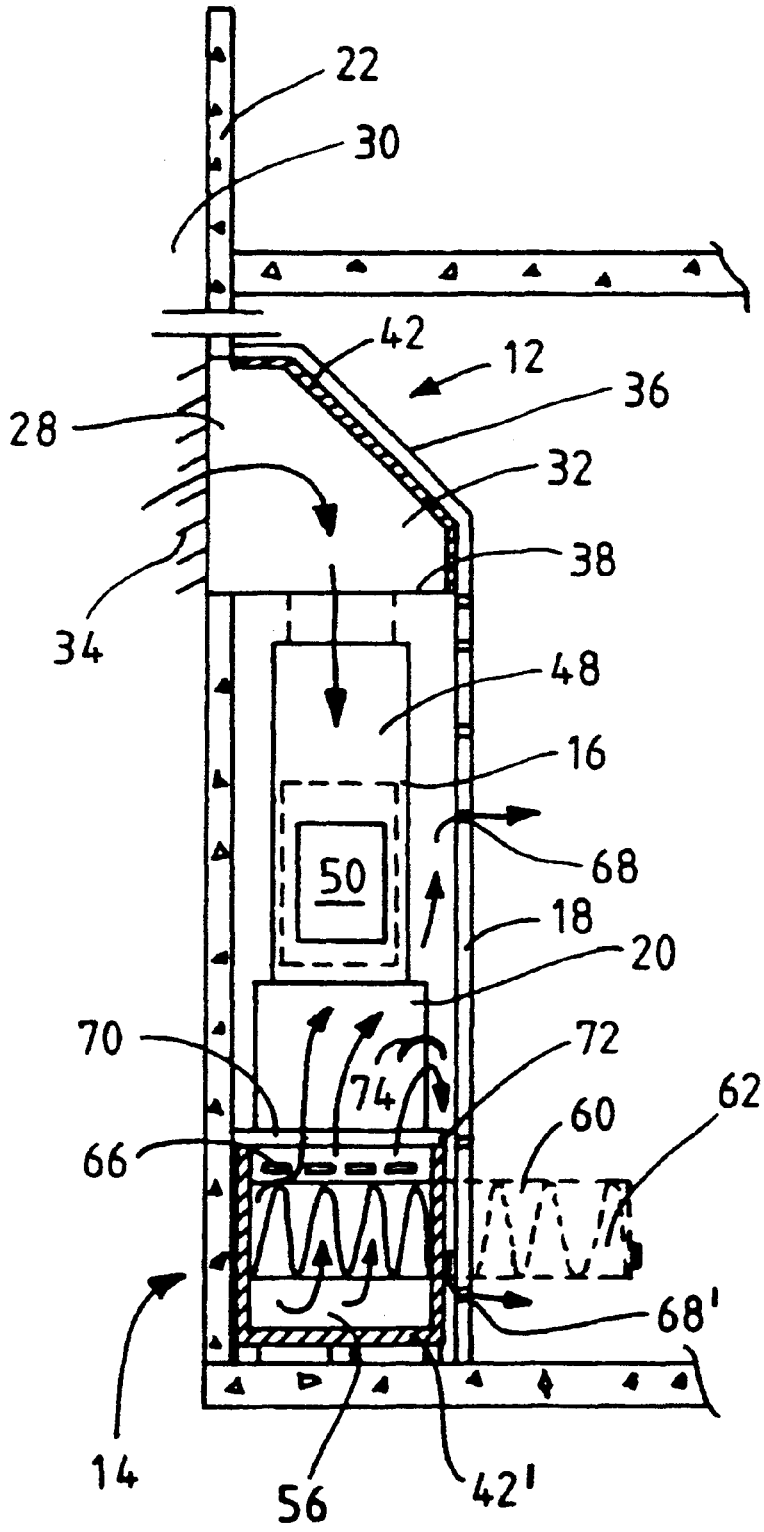

The invention is described in more detail below with reference to the enclosed drawings, in which FIG. 1 shows schematically the supply air system according to the invention from the front side as seen toward the machine room's wall, in the state during service; and FIG. 2 shows the system of FIG. 1 in the cross section of line AA.

FIGS. 1 and 2 show the supply air system 10 according to the invention in the machine room of a paper mill. The supply air system is formed by the following separate modules: a supply air unit 12, an air treatment unit 14, vertical ducts 16, 16', and the air distribution plates 18, 18'. Between these components 12, 14, 16, 16', 18, 18' an air chamber 20 is formed when the air distribution plates are in the normal position indicated by the broken lines 19, 19'. The supply air system is arranged between two columns 24, 24' of the machine room wall 22. The floor 26 of the machine room forms the supporting frame for the components 12, 14, 16, 16', 18, 18'.

In the machine room wall 22 at a height of about 3 to 8 meters, typically at a height of about 4 meters above the machine room floor, there is formed an opening 28 (FIG. 2) from which air flows in the manner indicated by the arrow from the outside 30 into the internal space 32 of the supply air unit. In front of the opening 28 there is mounted a louver 34 outside the wall, whereby the louver prevents e.g. rain water from entering the internal spaces through the opening. When desired it is possible to combine such devices with the louver which are able to pre-heat the supply air. When desired the opening can be covered on the outer side by a hood which acts as a shelter from the rain and/or insulates noise when required.

The supply air unit 12 is formed by a box-like structure having a partly inclined part 36 forming the roof and the front wall, a bottom 38 and sides 40, 40'. In the case shown in the figures the unit has no back wall, as the unit is mounted tightly against the wall 22. If the supply air unit is arranged freely standing on the floor and the air supply to the unit is arranged e.g. via its roof, then also a back wall must be arranged in the supply air unit.

The walls of the air supply unit which face the machine room are made of sound insulating material 42, such as isolating plate. Further the walls can be lined with a sound insulating material.

Openings 44, 44' are formed in the lower part of the supply air unit, where vertical ducts 16, 16' with thick jackets are connected to the openings. Axial blowers 48, 48' represented by broken lines are arranged in the upper parts of the vertical ducts. At the location of the blowers there are made maintenance manholes 50, 50' in the vertical ducts. Below the blowers 48, 48' in the ducts 16, 16' there are arranged silencers 52, 52' shown by broken lines. The vertical ducts are supported on the floor 26.

The air treatment unit 14 is arranged between the lower parts of the vertical ducts. Openings 54, 54' are formed in the lower parts of the ducts, the openings communicating with the air box 56 in the lower part of the air treatment unit. Above the air box 56 in the unit 14 a filter 58 is arranged which filter comprises filter cassettes 62 arranged in drawers 60. The drawers can be pulled out from the unit into the machine room, as shown by broken lines in FIG. 2, in order to clean or replace the filters. The upper part of the air box 56 is at least partly open, so that air can flow from the air box to the filter 58 located above it.

In the typical system according to the invention shown in FIGS. 1 and 2 there is further mounted above the filter 58 a heating radiator 64 known as such for heating the supply air. In the heating radiator there are mounted heating elements 66, which heat the air flowing past them. In a manner known as such a heating medium, such as hot water or steam, can be directed through the heating elements, which is not shown in more detail in the figures.

The heating radiator can be arranged mainly in a horizontal plane, or when desired, inclined so that for instance the edge of the radiator which is closest to the wall is on a higher level than the edge of the radiator which is closest to the air distribution plates. The radiator can be in an angle of more than 45 degrees, even 60 degrees, regarding the horizontal plane, in which case it can be considerably larger than a horizontal radiator. By increasing the radiator size the flow velocity through the radiator can be correspondingly reduced and a more effective heat transfer can be obtained.

The treated air which has flowed through the air box 56, the filter 58 and the heating radiator 64 is distributed into the air chamber 20 between the units 12 and 14. From the air chamber the air flows evenly into the machine room through the openings 68 in the distribution plates 18, 18' when the openings are in their closed position indicated by the broken lines 19, 19' (in FIG. 1). The figures show only a few of the openings 68.

The air distribution plates 18, 18' can be movable like a sliding door, as shown in FIG. 1. During service the air distribution plates are pulled away from their position in the front of the air chamber, so that the maintenance personnel can step up on a maintenance gallery 70 or the like arranged above the air treatment unit, from where it is possible to service both the blower in the duct 16, 16' and the heating radiator 64 below the gallery 70. The maintenance gallery is typically about 1 to 1.5 meters above the floor level. In the system it is possible to arrange steps in a suitable place (not shown), from where it is easy to step up on the maintenance gallery. If there are no filters below the heating radiator it will be possible to spray washing water from the maintenance gallery through the heating radiator in order to clean it. Then a gutter can be arranged at the bottom of the air box 56 in the air treatment unit in order to lead away the washing water.

As can be seen in FIG. 2 that the air distribution plates 18, which resemble slidincg doors, can be arranged so that a gap 72 of for instance 10 to 25 cm is left between the air treatment unit 14 and the plate 18. Then, the treated supply air can be directed from the air chamber 20 also into this gap 72 and through the openings 68' in the air distribution plate at the gap into the machine room, in other words at a relatively low level into the machine room. The air flow into the gap 68' can be intensified with the aid of a curved plate 74, which is arranged into the air flow at a short distance from the air treatment unit. As can be seen in FIG. 2 that the walls of the air treatment unit are made of a soundproof material 42'.

The invention has been described above by referring mainly to one embodiment. However, the intention is to be able to apply the invention widely within the scope defined in the claims presented below.

Thus, when required, it is possible to arrange also in the supply air box different air treatment devices, such as preheating radiators, air louvers and/or sound insulating elements. On the other hand, in the actual air treatment unit it is not necessary in all embodiments both to clean the air and to adjust the air temperature, but it is possible to do only either of these.

From the supply air unit the air can be directed to the air treatment unit, for instance through only one vertical duct, which can be arranged for instance in the middle of the system. Then it may be necessary to take care of supporting the supply air unit by some other means than only by the vertical duct. Of course there may also be more than 2 vertical ducts next to each other. A silencer can be arranged in the vertical ducts on both sides of the blower, if desired.

The supply air system is typically mounted between two columns next to the wall of the machine room, but if desired, it may be mounted between two columns in the middle of the machine room, or freely in the machine room. The supply air system is enclosed on all sides, and an air distribution plate which can be opened is arranged at least on one side, when desired on two opposite sides. In the latter case air can be blown in two different directions from the supply air system mounted free-standing in the middle of the machine room.

Instead of the external air, or in addition to it, air from the machine room can be supplied to the supply air system. When required the air can be cleaned/filtered, cooled, moistened, dried, in the system.

Above it was mentioned that also other blowers than axial ones can be used. The main thing is that the air can be conveyed in a controlled way from the supply air unit to the air treatment unit.

The solution according to the invention is inexpensive and can be realised in a simple way. The maintenance of the system is easy as the objects to be serviced are either located on a low level or they are easily accessible from machine level. Thus the devices can be serviced sufficiently often, which increases their operative life. The invention further makes it possible to provide efficient sound insulation.

What is claimed is:

1. An air supply system supplying air to a room interior comprising:

a supply air unit having an air inlet connected to air outside of the room;

an air treatment unit spaced below the air inlet;

an air chamber for treated air, formed between the air inlet and the air treatment unit;

an air distribution plate, which is perforated to allow air to pass therethrough, separating the air chamber for treated air, from the room interior;

at least one air duct extending between the supply air unit, and the air treatment unit;

wherein an air flow path is defined from outside the room through the air inlet of the supply air unit downwardly through the air duct and into the air treatment unit, the flow path further extending upwardly through the air treatment unit into the air chamber for treated air, and out of the air chamber for treated air, through the air distribution plate into the room interior;

at least one blower positioned along the air flow path to urge air along said path, and at least one air treatment device positioned within the air treatment unit, the air path passing through the at least one air treatment device.

2. The system of claim 1 wherein the at least one blower has an input side and an output side, and the at least one blower is arranged in the air duct interconnecting the supply air unit and the air treatment unit.

3. The system of claim 2 wherein a silencer is arranged in the air duct on the input side of the blower.

4. The system of claim 2 wherein a silencer is arranged in the duct on the output side of the blower.

5. The system of claim 2 wherein the supply air unit and the air treatment unit are interconnected by at least two ducts, each duct being equipped with a blower.

6. The system of claim 1 wherein at least two ducts are arranged between the supply air unit and the air treatment unit, so that the air chamber is formed between the at least two ducts, and the air distribution plate is arranged in front of the air chamber for directing the treated air from the air chamber into the room.

7. The system of claim 1 wherein supply air connections are arranged in the lower part of the air treatment unit, and air discharge connections are arranged in the top part of the air treatment unit.

8. The system of claim 1 wherein an upper part of the at least one air duct is connected to a lower part of the supply air unit and a lower part of the at least one air duct is connected to a lower part of the air treatment unit.

9. The system of claim 1 wherein the at least one air treatment device comprises:

a filter for separating dust from air passing through the air treatment unit; and a heat exchange radiator arranged after the filter, in the flow direction, in order to heat or cool the filtered air.

10. The system of claim 9 wherein the filter comprises one or more filter cassettes which can be pulled out from the air treatment unit into the room for maintenance or replacement.

11. The system of claim 1 wherein a maintenance gallery is arranged in the air chamber between the supply air unit and the air treatment unit.

12. The system of claim 1 wherein the air distribution plate is formed by at least one, mainly vertical, plate-like element, arranged to be movable to provide access to the air chamber for treated air.

13. The system of claim 1 wherein the at least one blower is a vertical axial blower, and the blower is arranged in the at least one air duct extending between the supply air unit and the air treatment unit, and wherein the air duct is sound insulating.

14. The system of claim 1 wherein the supply air unit is formed by a horizontal box structure having walls which face the room lined so that they insulate sound.

15. The system of claim 1 wherein the air treatment unit is formed by a horizontal box-like structure with an air distribution box formed in its lower part in order to direct the supply air from the lower part of the duct interconnecting the units to the air treatment unit, and wherein the air distribution box is insulated with a soundproof material.

16. The system of claim 1 wherein the supply air unit, the air treatment unit and the ducts between them are separate modules, which in connection with installation are arranged with the air duct connected to the air treatment unit, and the supply air unit positioned on top of the air duct to form a self-supporting structure.

17. The system of claim 1 wherein the space between the air treatment unit and the supply air unit forms a maintenance space from where the supply air system can be serviced.

18. An air supply system for supplying air into a machine room comprising:

a supply air unit having an air inlet;

an air treatment unit spaced below the air inlet;

an air chamber for treated air, defined between the air inlet and the air treatment unit;

wherein the supply air system is enclosed on all sides, and a perforated vertical air distribution plate is arranged on at least one side of the air supply system, the distrbution plate is arranged to be movable in front of the air treatment units so when the air distribution plate is in front of the air treatment units, air can flow from the air treatment units into the machine room through the openings in the plate, and the air distribution plates can be pulled away from a position in front of the air treatment units, so as to provide service access;

at least one air duct extending between the supply air unit and the air treatment unit;

wherein an air flow path is defined from outside the room through the inlet of the supply air unit downwardly through the air duct and into the air treatment unit, the flow path further extending upwardly through the air treatment unit into the air chamber for treated air, and out of the air chamber for treated air, through the air distribution plate;

at least one blower positioned along the air flow path to urge air along said path; and at least one air treatment device positioned within the air treatment unit, the air path passing through the at least one air treatment device.

19. The system of claim 18 wherein the perforated plate is arranged to be movable like a sliding door.

20. The system of claim 18 wherein the perforated plate is arranged to be movable like a common door.

21. A method of assembling from modular components an air supply system for supplying air into a machine room having a floor, and an interior, the method comprising the steps of:

placing on the machine room floor a first module which is an air treatment unit for treating air having at least one air treatment device therein;

mounting at least two spaced apart second modules which are air ducts to the first module, each air duct having a blower mounted therein, the air ducts connecting to the air treatment unit;

arranging on top of the second modules, a third module which is a supply air unit having an air inlet connected to air outside of the machine room, the supply air unit connecting to the second modules; thus forming a self-supporting structure and an air chamber for treated air between the supply air unit and the air treatment unit and the two air ducts;

arranging the self-supporting structure with respect to a perforated vertical air distribution plate for distributing treated air into the machine room; and movable in front of the self-supporting structure so when the air distribution plate is in front of the self-supporting structure air can flow from the self-supporting structure into the machine room through the openings in the plate, and the air distribution plates can be pulled away from a position in front of the self-supporting structure, so as to provide service access;

wherein an air flow path is defined from outside the machine room through the inlet of the supply air unit downwardly through the air ducts and into the air treatment unit, the flow path further extending upwardly through the air treatment unit into the air chamber for treated air, and out of the air chamber for treated air, through the air distribution plate into the machine room interior.

* * * * *